US010388209B2

(12) United States Patent
Kadota

(10) Patent No.: US 10,388,209 B2
(45) Date of Patent: Aug. 20, 2019

(54) INTERFACE CIRCUIT

(71) Applicant: LAPIS Semiconductor Co., Ltd., Yokohama (JP)

(72) Inventor: Daisuke Kadota, Yokohama (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 0 days.

(21) Appl. No.: 15/717,211

(22) Filed: Sep. 27, 2017

(65) Prior Publication Data

US 2018/0090056 A1 Mar. 29, 2018

(30) Foreign Application Priority Data

Sep. 28, 2016 (JP) ..... 2016-189936

(51) Int. Cl.
*G09G 3/20* (2006.01)
*G09G 3/00* (2006.01)

(52) U.S. Cl.
CPC ..... *G09G 3/2096* (2013.01); *G09G 3/006* (2013.01); *G09G 2310/08* (2013.01); *G09G 2330/12* (2013.01); *G09G 2370/08* (2013.01); *G09G 2370/14* (2013.01)

(58) Field of Classification Search
None
See application file for complete search history.

(56) References Cited

U.S. PATENT DOCUMENTS 6,023,774 A * 2/2000 Minagawa ..... G06F 11/1443 370/242

FOREIGN PATENT DOCUMENTS

JP 2011-112970 A 6/2011

* cited by examiner

*Primary Examiner* — Kenneth B Lee, Jr.
(74) *Attorney, Agent, or Firm* — Rabin & Berdo, P.C.

(57) ABSTRACT

An interface circuit for supplying a plurality of data signals to a data reception circuit includes a timing signal generating circuit configured to generate a timing signal. The timing signal indicates a timing to switch operation of the interface circuit between a data input mode and a non-input mode. The interface circuit further includes a data control circuit configured to control a supply of the data signals to the data reception circuit in the data input mode, a plurality of abnormality detection circuits each configured to detect an abnormality that has occurred in the data reception circuit, and a select circuit configured to select one abnormality detection circuit based on each of the data signals supplied in the non-input mode of the interface circuit, and output, as an abnormality detection signal, a detection result of the selected one of the abnormality detection circuits.

5 Claims, 6 Drawing Sheets

INTERFACE CIRCUIT

BACKGROUND OF THE INVENTION

Technical Field

The present invention relates to an interface circuit.

Background Arts

In a liquid crystal display device, a video signal is sent from a display control device such as a timing controller to a source driver that drives a liquid crystal panel. For example, a mini-LVDS (mini-low voltage differential signaling) method is used for a transmission method of the video signal. The mini-LVDS method is one of differential signal methods in which a video signal is transmitted as a differential pair of signals, and one pair (two lines) of signal lines can transmit up to 8 bits of a video signal.

A liquid crystal display device is equipped with an abnormality detection circuit for detecting an abnormality that occurs in a source driver or the like. Known examples thereof include a source driver and a display device equipped with a temperature detection circuit configured to detect abnormal temperature caused by heat generated by an output buffer in the source driver (Japanese Patent Application Laid-open Publication No. 2011-112970, for example).

SUMMARY OF THE INVENTION

Some source drivers have a plurality of abnormal detection circuits configured to detect various types of abnormality such as an abnormal voltage value or abnormal polarity inversion, in addition to the abnormality detection circuit configured to detect abnormal temperature. In order to output the detection results of those abnormality detection circuits, each of the abnormality detection circuits is selected at a different timing, and the detection result of a selected circuit is output in a time division manner. In this process, an interface circuit in the source driver receives a selection signal from a display control device such as a timing controller, and selects an abnormality detection circuit in accordance with the selection signal.

In order to supply a selection signal from the display control device to the interface circuit, the interface circuit needed to have an additional input terminal for the selection signal, in addition to the input terminal for the video signal. Also, the display control device needed to be configured to control the selection signal independently of the video signal. Thus, if an input terminal cannot be added to the interface circuit or if the display control device is not capable of controlling signals other than the video signal, it would not be possible to select an abnormality detection circuit. In addition, if an input terminal was added to the interface circuit, or if the display control device was configured to be able to control the selection signal, the layout area of the liquid crystal display device would increase to accommodate such a configuration.

In order to solve those problems, the present invention aims at providing an interface circuit that can select one of a plurality of abnormality selection circuits based on an external signal and output the detection result of the selected circuit without requiring an additional input terminal.

According to an aspect of the invention, there is provided an interface circuit for receiving a clock signal and a plurality of data signals and supplying the plurality of data signals to a data reception circuit, including a timing signal generating circuit configured to generate a timing signal based on the clock signal and one of the data signals, the timing signal indicating a timing to switch operation of the interface circuit between a data input mode in which the data signals are supplied to the data reception circuit and a non-input mode in which the data signals are not supplied to the data reception circuit, a data control circuit configured to control a supply of the data signals to the data reception circuit based on the timing signal, a plurality of abnormality detection circuits each configured to detect an abnormality that has occurred in the data reception circuit, and a select circuit configured to select one of the plurality of abnormality detection circuits based on each of the plurality of data signals supplied in the non-input mode of the interface circuit, and output, as an abnormality detection signal, a detection result of the selected one of the abnormality detection circuits at a timing corresponding to the clock signal during the operation of the interface circuit in the non-input mode.

According to an aspect of the invention, there is provided a data control circuit for supplying a plurality of data signals to a data reception circuit and a detection circuit, the detection circuit being configured to detect an abnormality that has occurred in the data reception circuit, including a plurality of data signal lines, a timing signal generating circuit configured to generate a timing signal based on a clock signal and one of the plurality of data signals from the plurality of data signal lines, the timing signal indicating a timing to switch operation of the data control circuit between a data input mode in which the data signals are supplied to the data reception circuit and a non-input mode in which the data signals are not supplied to the data reception circuit, and an input data control circuit configured to receive the timing signal and the signals from the plurality of data signal lines, in the data input mode of the data control circuit, supply the plurality of data signals from the plurality of data signal lines to the data reception circuit as the plurality of data signals, and in the non-input mode of the data control circuit, supply the plurality of data signals from the plurality of data signal lines to the detection circuit to be used for generating an abnormality detection signal that indicates an existence of the abnormality of the data reception circuit.

An interface circuit according to the invention selects one of a plurality of abnormality detection circuits based on an input data signal supplied from a display controller, and outputs the detection result of the selected circuit. By making selection based on the input data signal, it is possible to detect an abnormality detection circuit and output the detection result without requiring an additional input terminal for the selection signal.

BRIEF DESCRIPTIONS OF THE DRAWINGS

DETAILED DESCRIPTION OF EMBODIMENTS

Figure 1:
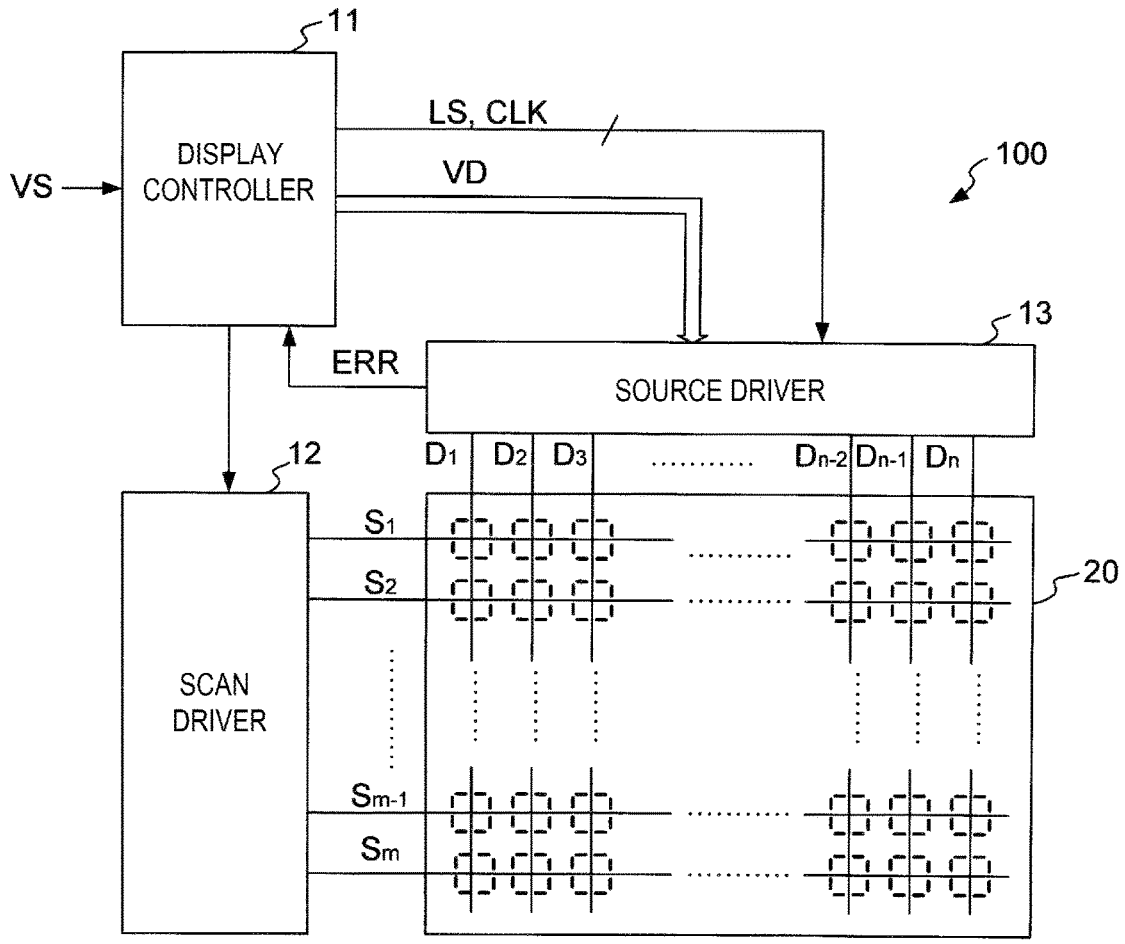
FIG. 1 is a block diagram showing the configuration of a display device 100 of the present invention.

Embodiments of the present invention will be explained below with reference to figures. In the descriptions of respective embodiments below and appended figures, components and parts that are substantially the same or equivalent to each other are given the same reference characters.

Embodiment 1

FIG. 1 is a block diagram showing the configuration of a display device 100 including an interface circuit of the present invention. As shown in FIG. 1, the display device 100 includes a display controller 11, a scan driver 12, a source driver 13, and a display device 20.

The display device 20 is an image display device made of a liquid crystal display panel or organic EL (electroluminescence) panel, for example. In the display device 20, m-number (m is a natural number of 2 or greater) of horizontal scan lines S1 to Sm that extend in the horizontal direction of the two-dimensional screen, and n-number (n being a natural number of 2 or greater) of source lines D1 to Dn that extend in the vertical direction of the two-dimensional screen are formed. At each intersection of the horizontal scan lines and the source lines, or in other words, in each area enclosed by the broken line in FIG. 1, a display cell that functions as a pixel is formed.

The display controller 11 is made of a timing controller (TCON) or the like, for example, and supplies a video data signal VD, a clock signal CLK, and a line start signal LS to the source driver 13, thereby controlling the display timing of an image in the liquid crystal display panel. The display controller 11 transmits the video data signal VD with a differential signal method such as the mini-LVDS (mini-low voltage differential signaling), for example.

The display controller 11 generates a series of pixel data PD that represents the luminance level of each pixel with 6 bits of gradation based on the input video signal VS, and supplies the video data signal VD including this series of pixel data PD to the source driver 13. In the descriptions below, the video data signal VD includes input data signals LV0, LV1, and LV2, for example. The input data signals LV0, LV1, and LV2 change the signal level thereof between the logical level 1 and the logical level 0 based on the clock cycle of the clock signal CLK, and the input data signal is a differential signal transmitted by the mini-LVDS method. In the descriptions below, the logical level 1 is referred to as a high level (H), and the logical level 0 is referred to as a low level (L).

The display controller 11 also supplies to the source driver 13 the clock signal CLK and the line start signal LS indicating the location (start location) that divides the series of n-number of pixel data PD corresponding to the respective horizontal scan lines.

The display controller 11 detects a horizontal synchronization signal from the input video signal VS, and supplies the signal to the scan driver 12.

The scan driver 12 generates horizontal scan pulse in synchronization with the horizontal synchronization signal supplied from the display controller 11, and applies the horizontal scan pulse to each of the scan lines S1 to Sm of the display device 20 selectively.

The source driver 13 generates n-number of image driving voltage G1 to Gn for one horizontal scan line based on the video data signal VD, the line start signal LS and the clock signal CLK, and applies the voltages to the source lines D1 to Dn of the display device 20. The source driver 13 detects an abnormality in the source driver 13, generates an abnormality detection signal ERR indicating the detection results, and supplies the abnormality detection signal ERR to the display controller 11.

Figure 2:
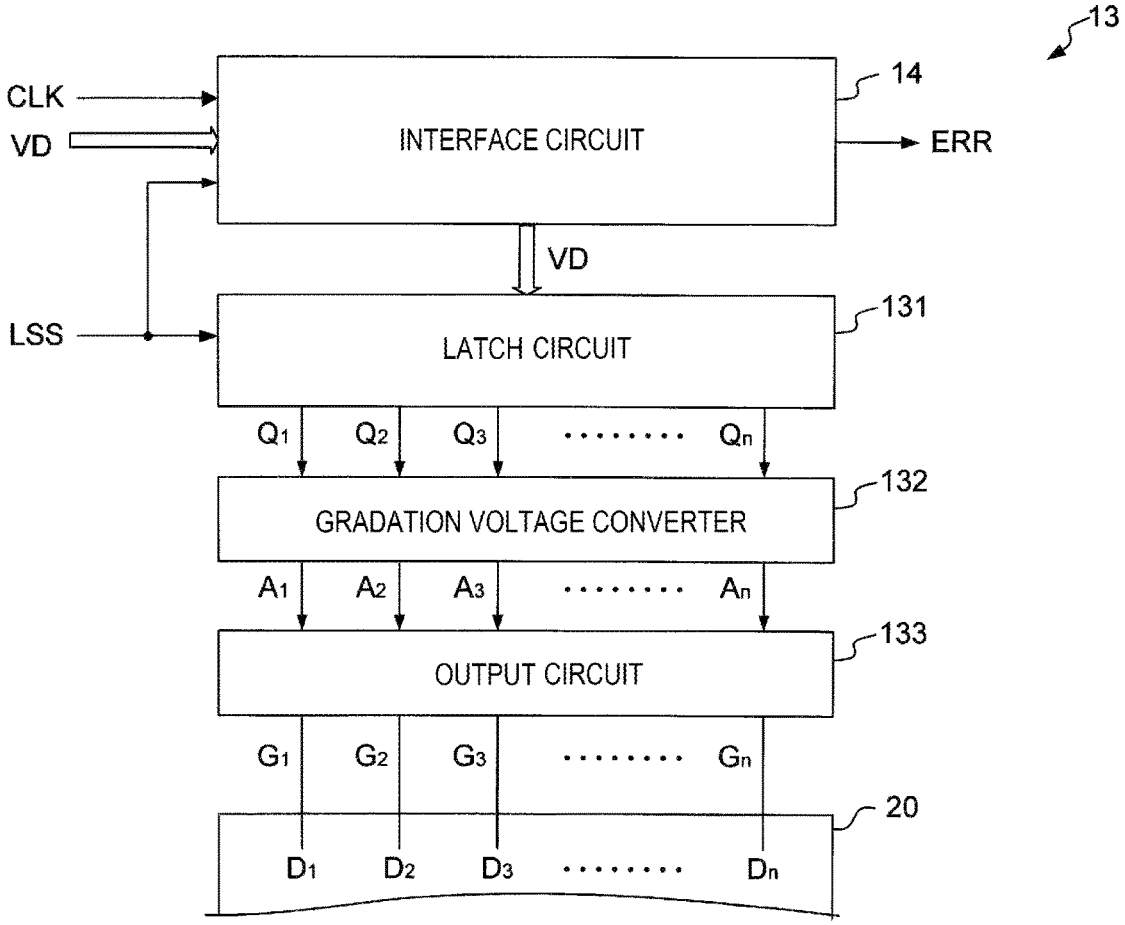
FIG. 2 is a block diagram showing the internal configuration of a source driver 13.

FIG. 2 is a block diagram showing the internal configuration of the source driver 13. As shown in FIG. 2, the source driver 13 includes a latch circuit 131, a gradation voltage converter 132, an output circuit 133, and an interface circuit 14.

The latch circuit 131 takes in the series of pixel data PD included in the video data signal VD supplied from the display controller 11 through the interface circuit 14 in an appropriate order. Every time the pixel data PD for one horizontal scan line (n) is obtained, the latch circuit 131 supplies the n-number of pixel data PD to the gradation voltage converter 132 as the pixel data Q1 to Qn in accordance with the latch start signal LSS.

The gradation voltage converter 132 converts each of the pixel data Q1 to Qn to gradation voltages A1 to An of positive polarity and negative polarity having the voltage values corresponding the luminance gradation levels represented by the pixel data Q.

The output circuit 133 generates pixel driving voltages G1 to Gn by respectively amplifying the gradation voltages A1 to An by gain 1, and supplies the respective pixel driving voltages G1 to Gn to the source lines D1 to Dn of the display device 20.

The interface circuit 14 receives the video data signal VD, the clock signal CLK, and the line start signal LS from the display controller 11, and supplies the video data signal VD to the latch circuit 131 at timings represented by those signals. The interface circuit 14 detects an abnormality in the source driver 13, and outputs an abnormality detection signal ERR indicating the detection results to the display controller 11.

Figure 3:
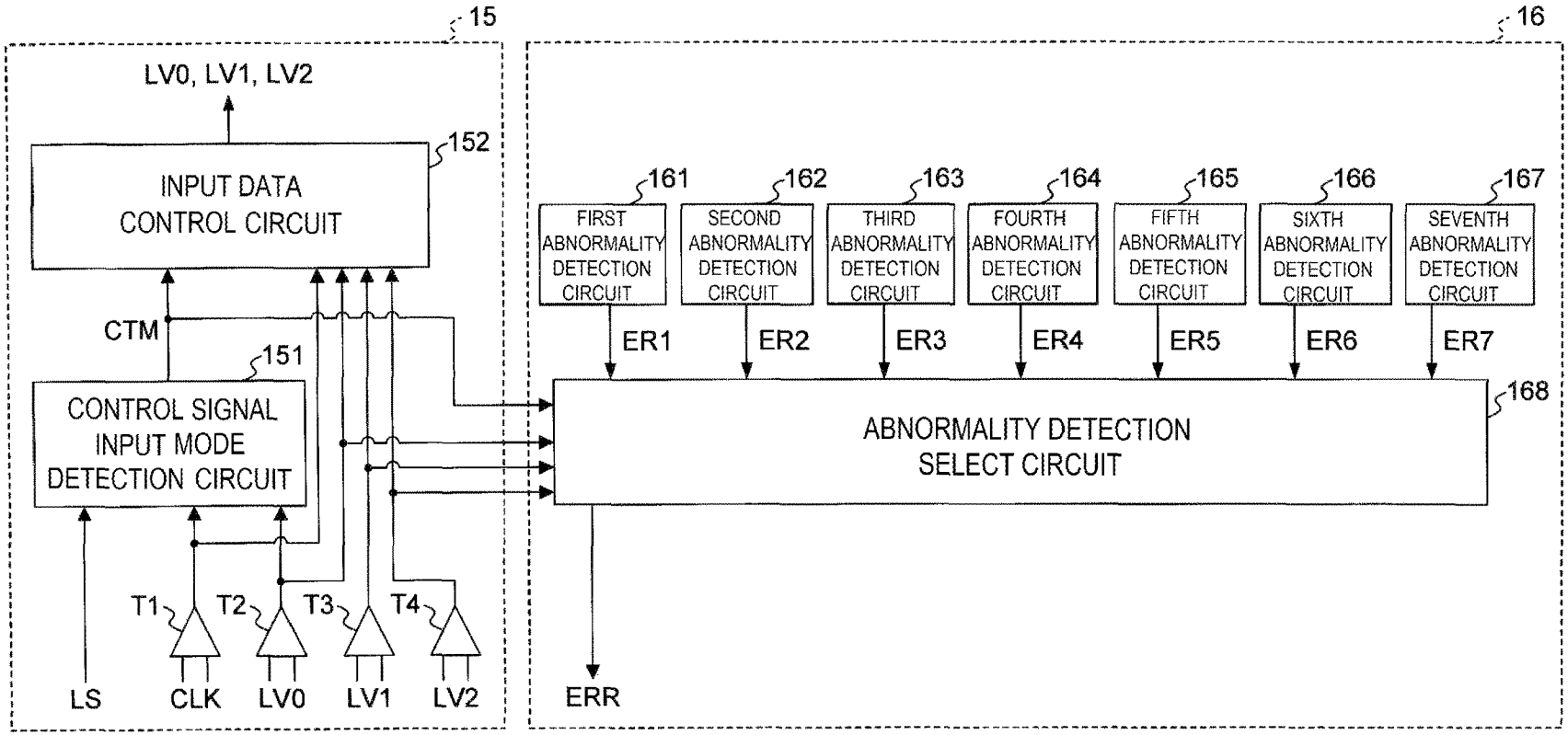
FIG. 3 is a block diagram showing the configuration of an interface circuit 14 of Embodiment 1.

FIG. 3 is a block diagram showing the configuration of the interface circuit 14. The interface circuit 14 includes a data control block 15 and an abnormality detection block 16.

The data control block 15 includes a control signal input mode detection circuit 151 and an input data control circuit 152. The data control block 15 has input terminals T1, T2, T3, and T4 to receive the clock signal CLK and input data signals LV0 to LV2. The input terminals T1, T2, T3, and T4 are connected to the display controller 11 through respective data signal lines (not shown in the figure).

The control signal input mode detection circuit 151 detects the period of a data input mode (data input period) and the period of a control signal input mode (data non-input mode) (data non-input period) based on the line start signal LS, the clock signal CLK, and the input data signal LV0, for example. In the data input mode, the input data LV0, LV1, and LV2 are supplied to the latch circuit 131, and in the control signal input mode, the input data LV0, LV1 and LV2 are not supplied to the latch circuit 131 and instead control signals other than the input data signals are supplied. For example, when the signal level of the input data signal LV0 stays at the logical level 1 over two clock periods, and then goes down to the logical level 0 in the subsequent clock period (or in other words, when the signal level changes as H→H→L over three clock periods), the control signal input mode detection circuit 151 detects that the input mode is switched from the control signal input mode to the data input mode.

The control signal input mode detection circuit 151 generates a control mode signal CTM that indicates whether the input mode is the control signal input mode or not by the signal level, and supplies the control mode signal CTM to the input data control circuit 152 and the abnormality detection select circuit 168. This control mode signal CTM has the property as a timing signal that indicates the timing to switch between the period of the control signal input mode and the period of the data input mode by a change in signal level.

The input data control circuit 152 supplies the input data signals LV0, LV1, and LV2 to the latch circuit 131 during the data input mode period.

The clock signal CLK input into the input terminal T1 is supplied to the control signal input mode detection circuit 151 and the input data control circuit 152. The input data signal LV0 input into the input terminal T2 is supplied to the control signal input mode detection circuit 151, the input data control circuit 152, and the abnormality detection select circuit 168. The input data signals LV1 and LV2 input into the input terminals T3 and T4 are supplied to the input data control circuit 152 and the abnormality detection select circuit 168.

The abnormality detection block 16 includes a first abnormality detection circuit 161, a second abnormality detection circuit 162, a third abnormality detection circuit 163, a fourth abnormality detection circuit 164, a fifth abnormality detection circuit 165, a sixth abnormality detection circuit 166, and a seventh abnormality detection circuit 167 (will be collectively referred to as the first to seventh abnormality detection circuits 161 to 167), and an abnormality detection select circuit 168.

The first to seventh abnormality detection circuits 161 to 167 detect abnormal states of the source driver 13 such as abnormal temperature, abnormal voltage, and abnormal polarity inversion. The first to seventh abnormality detection circuits 161 to 167 are respectively configured to detect different types of abnormality. The first to seventh abnormality detection circuits 161 to 167 supply detection result signals ER1 to ER7 indicating the respective results of the abnormality detection to the abnormality detection select circuit 168.

The abnormality detection select circuit 168 selects each one of the first to seventh abnormality detection circuits 161 to 167 at a different clock timing, based on the control mode signal CTM, and input data signals LV0, LV1, and LV2, which are supplied from the data control block 15, and outputs the detection result signal of the selected abnormality detection circuit as an abnormality detection signal ERR.

Figure 4:
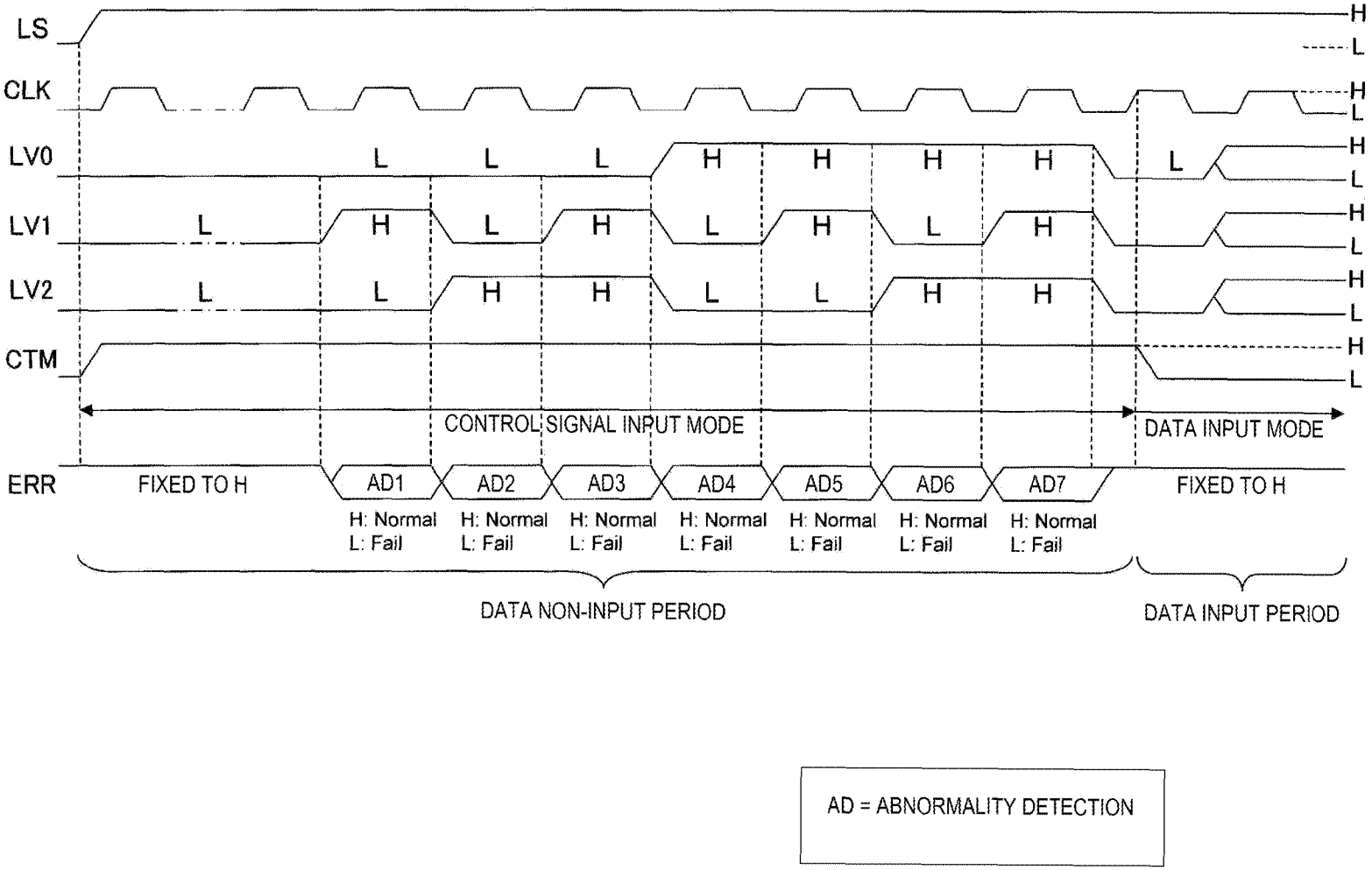
FIG. 4 is a time chart for explaining the operation of the interface circuit 14 of Embodiment 1.

Next, the operation of the data control block 15 and the abnormality detection block 16 will be explained with reference to the time chart of FIG. 4. The control mode signal CTM stays at the high level (H) during the control signal input mode, and stays at the low level (L) during the data input mode. The abnormality detection signal ERR stays at the high level (H) in the normal state where no abnormality is detected, and goes down to the low level (L) when an abnormality is detected.

The control signal input mode detection circuit 151 generates the control mode signal CTM that rises to the high level (H) at the same time as the rise of the line start signal LS, and supplies the control mode signal CTM to the input data control circuit 152 and the abnormality detection select circuit 168. As long as the control mode signal CTM is at the high level (H), the period of the control signal input mode (i.e., data non-input period) continues, and therefore, the input data control circuit 152 does not supply the input data signals LV0, LV1, and LV2 to the latch circuit 131. On the other hand, the abnormality detection select circuit 168 selects one of the first to seventh abnormality detection circuits 161 to 167 and outputs the detection result thereof during that period. That is, in the control signal input mode, while the control mode signal CTM is in the high level, the input data signals LV0, LV1, and LV2 are used as selection signals for selecting one of the first to seventh abnormality detection circuits 161 to 167.

If the input data signals LV0, LV1, and LV2 are all at the low level (L), the abnormality detection select circuit 168 does not select any of the first to seventh abnormality detection circuits 161 to 167, and outputs the high-level (H) abnormality detection signal ERR.

If the input data signals LV0 and LV2 are at the low level (L), and the input data signal LV1 is at the high level (H), the abnormality detection select circuit 168 selects the first abnormality detection circuit 161. The abnormality detection select circuit 168 outputs a low-level (L) abnormality detection signal ERR when an abnormality is detected, and outputs a high-level (H) abnormality detection signal ERR when no abnormality is detected, in accordance with the detection result signal ER1 supplied from the first abnormality detection circuit 161.

If the input data signals LV0 and LV1 are at the low level (L), and the input data signal LV2 is at the high level (H), the abnormality detection select circuit 168 selects the second abnormality detection circuit 162. The abnormality detection select circuit 168 outputs a low-level (L) abnormality detection signal ERR when an abnormality is detected, and outputs a high-level (H) abnormality detection signal ERR when no abnormality is detected, in accordance with the detection result signal ER2 supplied from the second abnormality detection circuit 162.

If the input data signal LV0 is at the low level (L), and the input data signals LV1 and LV2 are at the high level (H), the abnormality detection select circuit 168 selects the third abnormality detection circuit 163. The abnormality detection select circuit 168 outputs a low-level (L) abnormality detection signal ERR when abnormality is detected, and outputs a high-level (H) abnormality detection signal ERR when no abnormality is detected, in accordance with the detection result signal ER3 supplied from the third abnormality detection circuit 163.

If the input data signal LV0 is at the high level (H), and the input data signals LV1 and LV2 are at the low level (L), the abnormality detection select circuit 168 selects the fourth abnormality detection circuit 164. The abnormality detection select circuit 168 outputs a low-level (L) abnormality detection signal ERR when abnormality is detected, and outputs a high level (H) abnormality detection signal ERR when no abnormality is detected, in accordance with the detection result signal ER4 supplied from the fourth abnormality detection circuit 164.

If the input data signals LV0 and LV1 are at the high level (H), and the input data signal LV2 is at the low level (L), the abnormality detection select circuit 168 selects the fifth abnormality detection circuit 165. The abnormality detection select circuit 168 outputs a low-level (L) abnormality detection signal ERR when abnormality is detected, and outputs a high-level (H) abnormality detection signal ERR when no abnormality is detected, in accordance with the detection result signal ER5 supplied from the fifth abnormality detection circuit 165.

If the input data signals LV0 and LV2 are at the high level (H), and the input data signal LV1 is at the low level (L), the abnormality detection select circuit 168 selects the sixth abnormality detection circuit 166. The abnormality detection select circuit 168 outputs a low-level (L) abnormality detection signal ERR when an abnormality is detected, and outputs a high-level (H) abnormality detection signal ERR when no abnormality is detected, in accordance with the detection result signal ER6 supplied from the sixth abnormality detection circuit 166.

If the input data signals LV0, LV1, and LV2 are all at the high level (H), the abnormality detection select circuit 168 selects the seventh abnormality detection circuit 167. The abnormality detection select circuit 168 outputs a low level (L) abnormality detection signal ERR when an abnormality is detected, and outputs a high-level (H) abnormality detection signal ERR when no abnormality is detected, in accordance with the detection result signal ER7 supplied from the seventh abnormality detection circuit 167.

Thereafter, the input data signal LV0 goes down to the low level (L), and because the input data signal LV0 has changed the signal level thereof as H→H→L over the three clock periods, the control signal input mode detection circuit 151 determines that the control signal input mode has been switched to the data input mode, and causes the signal level of the control mode signal CTM to go down to the low level (L).

After the low-level (L) control mode signal CTM is supplied to the abnormal detection select circuit 168, the abnormal detection select circuit 168 no longer selects an abnormal detection circuit. The abnormal detection select circuit 168 outputs the abnormal detection signal ERR with the signal level thereof being fixed to the high level (H).

After the signal level of the control mode signal CTM has changed to the low level (L), the input data control circuit 152 starts supplying the input data signals LV0, LV1, and LV2 to the latch circuit 131.

As described above, in the interface circuit 14 of the present invention, the abnormal detection select circuit 168 selects one of the first to seventh abnormal detection circuits 161 to 167 based on the input data signals LV0, LV1, and LV2, and outputs the detection results of the selected abnormal detection circuit. This means that there is no need to receive a different selection signal for selecting the abnormal detection circuit in addition to the input data signals LV0, LV1, and LV2, and therefore, there is no need to have an additional input terminal for such a selection signal, separately from the input terminals T1, T2, T3, and T4. Thus, with the interface circuit 14 of the present invention, it is possible to output the detection results of a plurality of abnormal detection circuits, without requiring an additional input terminal.

Embodiment 2

In addition to detecting an abnormality that has occurred in the source driver 13, the interface circuit 24 of this embodiment is configured to detect a line breakage of a data signal line (not shown in the figure) that transmits the input data signals LV0 to LV2 between the display controller 11 and the interface circuit 24.

Figure 5:
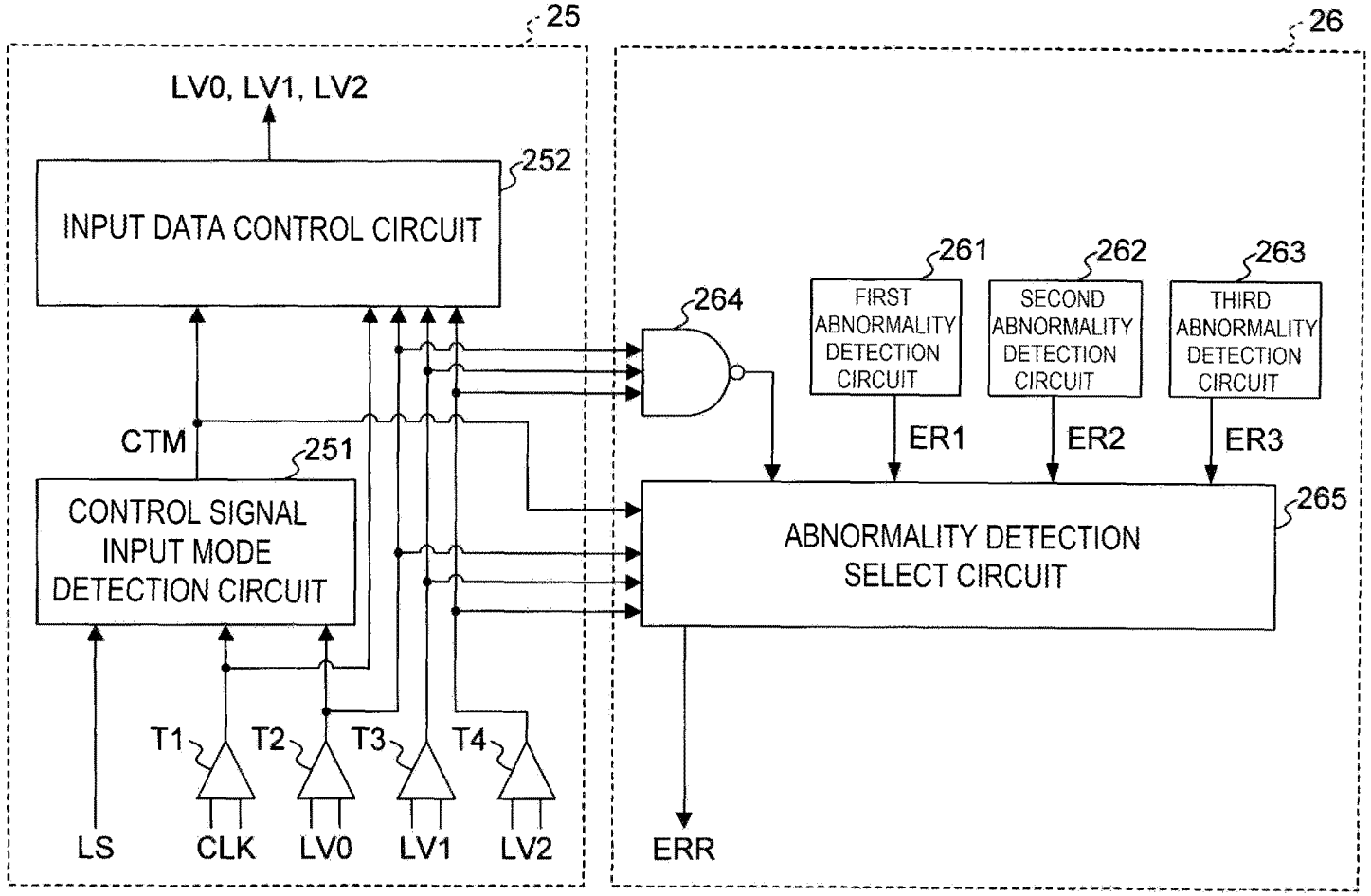
FIG. 5 is a block diagram showing the configuration of an interface circuit 24 of Embodiment 2.

FIG. 5 is a block diagram showing the configuration of an interface circuit 24 of Embodiment 2. The interface circuit 24 includes a data control block 25 and an abnormality detection block 26.

The data control block 25 includes a control signal input mode detection circuit 251 and an input data control circuit 252. The data control block 25 has input terminals T1, T2, T3, and T4 to receive the clock signal CLK and input data signals LV0 to LV2. The input terminals T1, T2, T3, and T4 are connected to the display controller 11 through respective data signal lines.

In a manner similar to the control signal input mode detection circuit 151 of Embodiment 1, the control signal input mode detection circuit 251 determines whether the current period is the period of the control signal input mode or the period of the data input mode, based on the line start signal LS, the clock signal CLK, and the input data signal LV0, generates the control mode signal CTM indicating, with the signal level thereof, whether the current mode is the control signal input mode or not, and supplies the control mode signal CMT to the input data control circuit 252 and the abnormality detection select circuit 265.

The input data control circuit 252 supplies the input data signals LV0, LV1, and LV2 to the latch circuit 131 during the period of the data input mode.

The clock signal CLK input into the input terminal T1 is supplied to the control signal input mode detection circuit 251 and the input data control circuit 252. The input data signal LV0 input into the input terminal T2 is supplied to the control signal input mode detection circuit 251, the input data control circuit 252, the abnormality detection select circuit 265, and an NAND circuit 264. The input data signals LV1 and LV2 input into the input terminals T3 and T4 are supplied to the input data control circuit 252, the abnormality detection select circuit 265, and the NAND circuit 264.

The abnormality detection block 26 includes a first abnormality detection circuit 261, a second abnormality detection circuit 262, and a third abnormality detection circuit 263 (hereinafter collectively referred to as the first to third abnormality detection circuits 261 to 263), an NAND circuit 264, and an abnormality detection select circuit 265.

The first to third abnormality detection circuits 261 to 263 detect abnormal states of the source driver 13 such as abnormal temperature, abnormal voltage, and abnormal polarity inversion. The first to third abnormality detection circuits 261 to 263 are respectively configured to detect different types of abnormality. The first to third abnormality detection circuits 261 to 263 supply detection result signals ER1 to ER3 indicating the respective results of the abnormality detection to the abnormality detection select circuit 265.

The NAND circuit 264 outputs an NAND signal NDS that is the NAND of the input data signals LV0, LV1, and LV2, and supplies the NAND signal NDS to the abnormal detection select circuit 265. For example, if one of the input data signals LV0, LV1, and LV2 is at the low level (L), the NAND circuit 264 outputs a high-level (H) NAND signal NDS. On the other hand, if all of the input data signals LV0, LV1, and LV2 are at the high level (H), the NAND circuit 264 outputs a low-level (L) NAND signal NDS.

The abnormality detection select circuit 265 selects each one of the first to third abnormality detection circuits 261 to 263 at a different clock timing, based on the control mode signal CTM and the input data signals LV0, LV1, and LV2, which are supplied from the data control block 25, and outputs the detection result signal of the selected abnormality detection circuit as an abnormality detection signal ERR.

At a timing when none of the first to third abnormality detection circuits 261 to 263 is selected during the control signal input mode, the abnormality detection select circuit 265 outputs a signal having the signal level corresponding to the NAND signal NDS supplied from the NAND circuit 264 as the abnormality detection signal ERR. In the descriptions below, this abnormality detection signal ERR will be referred to as an abnormality detection signal ERR corresponding to the NAND output.

The abnormality detection signal ERR corresponding to the NAND output functions as the criteria to determine whether the data signal line that connects the display controller 11 and the input terminals T2, T3, and T4 to each other is broken or not. That is, if the data signal line is broken, the signal level of the input data signal input into the input terminals T2, T3, and T4 is fixed to one of the high level (H) or low level (L), regardless of the signal level of the signal output by the display controller 11. Thus, by comparing the signal level of the abnormality detection signal ERR based on the signal output by the display controller 11 with the signal level of the abnormality detection signal ERR based on the signal that was actually input into the input terminals, it is possible to determine whether the data signal line connecting the display controller 11 and the input terminals T2, T3, and T4 to each other is broken or not.

For example, if the display controller 11 outputs high-level (H) input data signals LV0 and LV1 and a low-level (L) input data signal LV2, but the signal level of the input data signal LV2 is fixed to the high level (H) due to a line breakage in the data signal line between the display controller 11 and the input terminal T4, the input terminals T2, T3, and T4 receive the input data signals LV0, LV1, and LV2 that are all high level (H). Thus, if there was no line breakage, the abnormality detection signal ERR would be at the high level (H) because two high-level signals and one low-level signal were supplied to the NAND circuit 264, but actually, the abnormality detection signal ERR is at the low level (L) because three high-level (H) signals are supplied to the NAND circuit 264 due to the line breakage.

Next, the operation of the data control block 25 and the abnormality detection block 26 will be explained with reference to the time chart of FIG. 6.

The control signal input mode detection circuit 251 generates the control mode signal CTM that rises to the high level (H) at the same time as the rise of the line start signal LS, and supplies the control mode signal CTM to the input data control circuit 252 and the abnormality detection select circuit 265. During the control signal input mode where the control mode signal CTM stays at the high level (H), the input data control circuit 152 does not supply the input data signals LV0, LV1, and LV2 to the latch circuit 131. On the other hand, the abnormality detection select circuit 265 selects one of the first to third abnormality detection circuits 261 to 263 and outputs the detection result during that period.

If the input data signals LV0, LV1, and LV2 are all low-level (L), the abnormality detection select circuit 265 does not select any of the first to third abnormality detection circuits 261 to 263, and outputs a high-level (H) abnormality detection signal ERR.

If the input data signals LV0 and LV2 are at the low level (L), and the input data signal LV1 is at the high level (H), the abnormality detection select circuit 265 selects the first abnormality detection circuit 261. The abnormality detection select circuit 265 outputs a low level (L) abnormality detection signal ERR when an abnormality is detected, and outputs a high level (H) abnormality detection signal ERR when no abnormality is detected, in accordance with the detection result signal ER1 supplied from the first abnormality detection circuit 261.

If the input data signals LV0 and LV1 are at the low level (L), and the input data signal LV2 is at the high level (H), the abnormality detection select circuit 265 selects the second abnormality detection circuit 262. The abnormality detection select circuit 265 outputs a low level (L) abnormality detection signal ERR when an abnormality is detected, and outputs a high level (H) abnormality detection signal ERR when no abnormality is detected, in accordance with the detection result signal ER2 supplied from the second abnormality detection circuit 262.

If the input data signal LV0 is at the low level (L), and the input data signals LV1 and LV2 are at the high level (H), the abnormality detection select circuit 265 selects the third abnormality detection circuit 263. The abnormality detection select circuit 265 outputs a low level (L) abnormality detection signal ERR when an abnormality is detected, and outputs a high level (H) abnormality detection signal ERR when no abnormality is detected, in accordance with the detection result signal ER3 supplied from the third abnormality detection circuit 263.

After the first to third abnormality detection circuits 261 to 263 output the abnormality detection results, the abnormality detection select circuit 265 no longer selects an abnormality detection circuit, and outputs the abnormality detection signal ERR corresponding to the NAND output instead of the detection results by the first to third abnormality detection circuits 261 to 263. From the completion of the output of the abnormality detection results of the first to third abnormality detection circuits 261 to 263 to the start of the data input mode (a period of time indicated as the "data abnormality detection" in FIG. 6), the abnormality detection select circuit 265 outputs the abnormality detection signal ERR corresponding to the NAND output.

Figure 6:
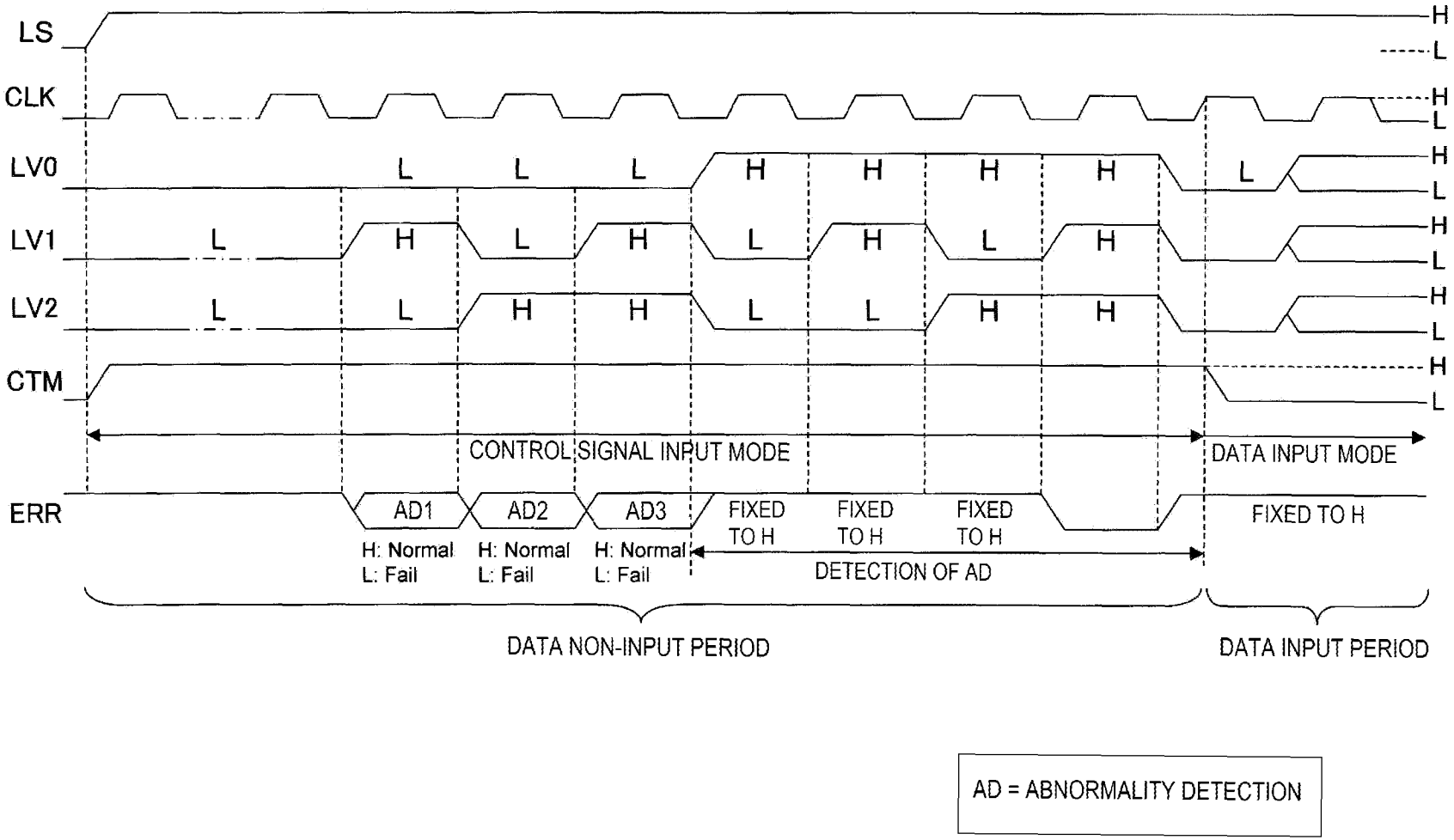
FIG. 6 is a time chart for explaining the operation of the interface circuit 24 of Embodiment 2.

FIG. 6 shows the signal output when there is no line break in the data signal line between the display controller 11 and the interface circuit 24 (or in other words, in the normal state). If the input data signal LV0 is at the high level (H), and LV1 and LV2 are at the low level (L), the NAND signal NDS is at the high level (H), and therefore, the abnormality detection select circuit 265 outputs a high-level (H) abnormality detection signal ERR. Similarly, if the input data signals LV0 and LV1 are at the high level (H) and LV2 is at the low level (L), or if the input data signals LV0 and LV2 are at the high level (H) and LV1 is at the low level (L), the NAND signal NDS is at the high level (H) as well, and therefore, the abnormality detection select circuit 265 outputs a high-level (H) abnormality detection signal ERR. On the other hand, if the input data signals LV0, LV1, and LV2 are all at the high level (H), the NAND signal NDS is at the low level (L), and therefore, the abnormality detection select circuit 265 outputs a low-level (L) abnormality detection signal ERR.

On the contrary, if there is a line breakage in the data signal line between the display controller 11 and the interface circuit 24, the abnormality detection signal ERR having different signal levels from those described above would be output. For example, if the data signal line breaks between the display controller 11 and the input terminal T4, which causes the input data signal LV2 to stay at the high level (H), the input data signals LV0, LV1 and LV2 supplied to the NAND circuit 264 would be all at the high level (H) at a timing where the input data signals LV0 and LV1 should be at the high level (H) and the LV2 should be at the low level (L). This causes the NAND signal NDS to be at the low level (L), and as a result, a low-level (L) abnormality detection signal ERR is output.

Similarly, if the data signal line breaks between the display controller 11 and the input terminal T3, which causes the input data signal LV1 to stay at the high level (H), the input data signals LV0, LV1 and LV2 supplied to the NAND circuit 264 would be all at the high level (H) at a timing where the input data signals LV0 and LV2 should be at the high level (H) and the LV1 should be at the low level (L). This causes the NAND signal NDS to be at the low level (L), and as a result, a low-level (L) abnormality detection signal ERR is output.

If the data signal line breaks between the display controller 11 and one of the input terminals T2, T3, and T4, which causes one of the input data signals LV0, LV1, and LV2 to stay at the low level (L), one of the input data signals LV0, LV1 and LV2 supplied to the NAND circuit 264 would be at the low level (L) at a timing where all of the input data signals LV0, LV1, and LV2 should be at the high level (H).

This causes the NAND signal NDS to be at the high level (H), and as a result, a high-level (H) abnormality detection signal ERR is output.

As described above, the interface circuit of this embodiment is configured to output a signal indicating NAND of the input data signals LV0, LV1, and LV2, in addition to selecting one of the plurality of abnormality detection circuits base on the input data signal, and outputting the detection results. By comparing the estimated signal level of the case in which there is no line breakage with the actual signal level, it is possible to detect a line breakage of the data signal line between the display controller 11 and one of the input terminals T2, T3, and T4.

The present invention is not limited to the respective embodiments above. For example, in the embodiments described above, the interface circuit 14 supplies the input data signals LV0, LV1, and LV2, which were supplied from the display controller 11, to the latch circuit 131. However, the circuit to which the interface circuit 14 supplies the input data signals LV0, LV1, and LV2 is not limited to the latch circuit 131. The interface circuit 14 may be configured to receive a plurality of data signals and supply those data signals to any data reception circuit.

In the embodiments described above, the video data signal VD includes input data signals LV0, LV1, and LV2, for example. However, the input data signals constituting the video data signal VD are not limited to those, and may include many other input data signals. That is, the video data signal VD may be constituted of LV0, LV1 . . . , LVn (n being a natural number), and the interface circuit of the present invention may be configured to use a part of the video data signal VD to select the abnormal detection circuit.

In the above description of Embodiment 1, one example in which the abnormality detection block 16 has seven abnormality detection circuits (first to seventh abnormality detection circuits 161 to 167) is explained, and in the above description of Embodiment 2, one example in which the abnormality detection block 26 has three abnormality detection circuits (first to third detection circuit 261 to 263) is explained. However, the number of abnormality detection circuits is not limited to those. For example, in the Embodiment 1, the input data signal LV3 may be used, in addition to the input data signals LV0, LV1, and LV2, to select each of 15 abnormality detection circuits, and output the detection results thereof. That is, by selecting an abnormality detection circuit using the input data signals LV0 to LVn (n being a natural number), it is possible to select each abnormality detection circuit out of $(2^n-1)$ abnormality detection circuits, and output the detection results.

In the embodiments described above, the display controller 11 is configured to transmit the video data signal VD (input data signals LV0, LV1, and LV2) by the differential signal method such as mini-LVDS, for example. However, the method to transmit the video data signal from the display controller 11 to the interface circuit 14 is not limited to this.

Also, the combination of the signal levels (H and L) to select each abnormality detection circuit is not limited to those described in the respective embodiments. In the above descriptions of embodiments, the configuration in which the first to seventh abnormality detection circuits 161 to 167 (first to third abnormality detection circuits 261 to 263) are selected in an appropriate order based on the timing of the clock signal is described, but the selection order of the abnormality detection circuits is not limited to this. That is, there is no special limitations on the combination or the order of the signals, and any combination or order may be used as long as each one of a plurality of abnormality detection circuits can be selected.

What is claimed is:

1. An interface circuit for receiving a clock signal and a plurality of data signals and supplying the plurality of data signals to a data reception circuit, comprising:

a timing signal generating circuit configured to generate a timing signal based on the clock signal and one of the data signals, the timing signal indicating a timing to switch operation of the interface circuit between a data input mode in which the data signals are supplied to the data reception circuit and a non-input mode in which the data signals are not supplied to the data reception circuit;

a data control circuit configured to control a supply of the data signals to the data reception circuit based on the timing signal;

a plurality of abnormality detection circuits each configured to detect an abnormality that has occurred in the data reception circuit; and a select circuit supplied with the plurality of data signals and configured to select one of the plurality of abnormality detection circuits based on each of the plurality of data signals supplied to the select circuit in the non-input mode of the interface circuit, and output, as an abnormality detection signal, a detection result of the selected one of the abnormality detection circuits at a timing corresponding to the clock signal during the operation of the interface circuit in the non-input mode.

2. The interface circuit according to claim 1, wherein the plurality of data signals include first to n-th data signals each changing a signal level thereof between a logical level 0 and a logical level 1 at a timing corresponding to a clock cycle of the clock signal, n being an integer of 2 or greater, and wherein the select circuit selects the one of the plurality of abnormality detection circuits in accordance with the signal level of each of the first to n-th data signals.

3. The interface circuit according to claim 2, wherein the timing signal generating circuit detects the signal level of at least one of the first to n-th data signals that has changed with a prescribed pattern, and generates the timing signal at a timing of detection of the prescribed pattern.

4. The interface circuit according to claim 1, further comprising a plurality of data signal lines through which the plurality of data signals are supplied to the data control circuit and the select circuit, wherein during the operation of the interface circuit in the non-input mode, the select circuits outputs the abnormality detection signal based on the plurality of data signals.

5. The interface circuit according to claim 4, further comprising a negative AND (NAND) gate receiving the plurality of data signals from the plurality of data signal lines and outputting a NAND result, wherein during the non-input mode of the interface circuit, the select circuit outputs the NAND result as the abnormality detection signal.

* * * * *